US010415312B1

(12) United States Patent
Conroy

(10) Patent No.: US 10,415,312 B1
(45) Date of Patent: Sep. 17, 2019

(54) LADDER SECURING DEVICE

(71) Applicant: William F. Conroy, Lisbon, ME (US)

(72) Inventor: William F. Conroy, Lisbon, ME (US)

( * ) Notice: Subject to any disclaimer, the term of this patent is extended or adjusted under 35 U.S.C. 154(b) by 0 days.

(21) Appl. No.: 15/984,037

(22) Filed: May 18, 2018

Related U.S. Application Data

(60) Provisional application No. 62/510,848, filed on May 25, 2017.

(51) Int. Cl.
*E06C 7/48* (2006.01)

(52) U.S. Cl.
CPC ..... *E06C 7/488* (2013.01)

(58) Field of Classification Search
CPC . E06C 7/488; E06C 1/04; A47B 95/00; F16B 2/12; F16B 2/18
See application file for complete search history.

(56) References Cited

U.S. PATENT DOCUMENTS 3,606,226 A * 9/1971 Bell, Sr. ..... E06C 1/345 182/206
4,386,542 A * 6/1983 Verna ..... B25B 7/02 81/420
D272,857 S * 2/1984 Leach ..... D25/68
4,603,756 A * 8/1986 Layher ..... E04G 7/307 182/186.8
4,643,275 A * 2/1987 LeBlanc ..... E06C 7/48 182/107
4,742,992 A * 5/1988 Allen ..... B25B 7/00 254/199
4,792,016 A * 12/1988 Ingalsbe ..... E06C 1/34 182/107
5,339,507 A * 8/1994 Cox ..... B25B 27/00 254/218
5,361,558 A * 11/1994 Thornton ..... A62B 35/0068 52/698
5,383,533 A 1/1995 Nikula et al.
6,086,051 A * 7/2000 Wiebe ..... A63C 19/00 256/24
6,550,577 B1 * 4/2003 Allgire ..... E06C 1/34 182/107
6,604,721 B2 * 8/2003 Ahl ..... E06C 7/146 182/129
8,302,927 B2 * 11/2012 Wright ..... A01D 34/001 248/156
8,316,993 B1 11/2012 Rudd
8,833,424 B2 * 9/2014 White ..... B60C 25/01 157/1.17
D742,610 S * 11/2015 Arvinte ..... D32/53.1
(Continued)

*Primary Examiner* — Katherine W Mitchell
*Assistant Examiner* — Candace L Bradford
(74) *Attorney, Agent, or Firm* — Cramer Patent & Design, PLLC; Aaron R. Cramer

(57) ABSTRACT

A ladder securing device provides a means to safely secure a ladder to an edge of a building structure while performing such activities as painting, construction, roofing projects, and the like. The device includes a ladder hooking portion, a turnbuckle, and a clamping assembly. The portions of the device are affixed to each other to form a length-adjustable assembly. It is envisioned that a pair of the devices would typically be utilized to hook onto opposing side rails of the ladder and to adjacent edge features of the building, and then tightened down using the turnbuckles.

8 Claims, 3 Drawing Sheets

(56) References Cited

U.S. PATENT DOCUMENTS

| | | | | |
|---|---|---|---|---|
| 2002/0088668 | A1* | 7/2002 | Moore | E06C 7/48 182/107 |
| 2003/0034206 | A1* | 2/2003 | Carroll, Jr. | E06C 5/00 182/127 |
| 2005/0011702 | A1* | 1/2005 | Zeaman | E06C 7/42 182/108 |
| 2006/0124394 | A1 | 6/2006 | Bracken et al. | |
| 2006/0272894 | A1 | 12/2006 | Hein et al. | |
| 2009/0000235 | A1* | 1/2009 | Kieran | E04B 1/24 52/656.9 |
| 2010/0116589 | A1* | 5/2010 | Mathieson | E04D 13/076 182/107 |
| 2012/0304424 | A1* | 12/2012 | Yang | F16B 2/12 24/457 |
| 2013/0199873 | A1 | 8/2013 | Prentice | |
| 2014/0166397 | A1 | 6/2014 | Reynolds | |
| 2015/0060629 | A1* | 3/2015 | Schmier, II | F16B 2/065 248/499 |
| 2015/0267471 | A1* | 9/2015 | Charlton | E06C 7/486 182/107 |

* cited by examiner

LADDER SECURING DEVICE

RELATED APPLICATIONS

The present invention was first described in and claims the benefit of U.S. Provisional Application No. 62/510,848 filed May 25, 2017, the entire disclosures of which are incorporated herein by reference.

FIELD OF THE INVENTION

The present invention relates generally to the field of devices for securing a ladder to a support structure.

BACKGROUND OF THE INVENTION

There is a seemingly endless list of activities performed at home, work, and countless other settings that require the use of an extension ladder in order to allow its user to gain access to areas that otherwise would be inaccessible. As ladder use is oftentimes a year-round necessity, many times such ladders are used in hazardous wintertime conditions where snow, ice, and otherwise slippery and unstable ground and supporting structure conditions exist.

Securing a ladder to the roof of a building or to some other location on the building is typically a necessary safety method that is advised or is some locations or job sites, a requirement. Regulations typically do not specify how to secure a ladder; as such, basically anything is acceptable as long as the ladder does not fall. However, many common methods for securing a ladder are used mainly in the name of ease of setting up and at a limited cost. These methods can include the use of a bungee cord or rope. These methods require something to tie your rope to or hook the bungee on to both the ladder and the building. Such methods would typically involve installing nails or screws into the roof or edge of the building.

There is then an advantage to providing a safe and easy way to secure a ladder without damaging property. The present ladder securing device fulfills this need.

SUMMARY OF THE INVENTION

The principles of the present invention provide for such a securing device that includes a hook configured to engage a side rail portion of a ladder, a turnbuckle, having a first end adjustably attached to the hook, and a clamp assembly adjustably and pivotally attached to a second end of the turnbuckle, capable of removable securement to a support structure. In some embodiments, a hook cover is provided to be removably placed on a portion of the hook.

An object of the present invention is to provide such a hook assembly having a first hook portion with a first hook first end removably attached to the turnbuckle first end, a second hook portion with a second hook first end perpendicularly extending away from a first hook second end, and a third hook portion with a third hook first end perpendicularly extending away from a second hook second end, disposed parallel with the first hook portion.

Another object of the present invention is to provide such a clamp assembly including an upper jaw with a generally "L"-shaped upper plate, a lower jaw with a lower plate, and a clamping tool for motioning the upper and lower jaws towards each other. The upper and lower plate have parallel and aligning facing surfaces. In at least one (1) embodiment, a gusset plate is affixed between the upper plate and upper jaw.

Yet another object is to have the clamp assembly further include a turnbuckle eyelet, having a first end removably attached to said turnbuckle second end, and a clamp eyelet located on a first side of the upper plate, capable of receiving a second end of the turnbuckle eyelet.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
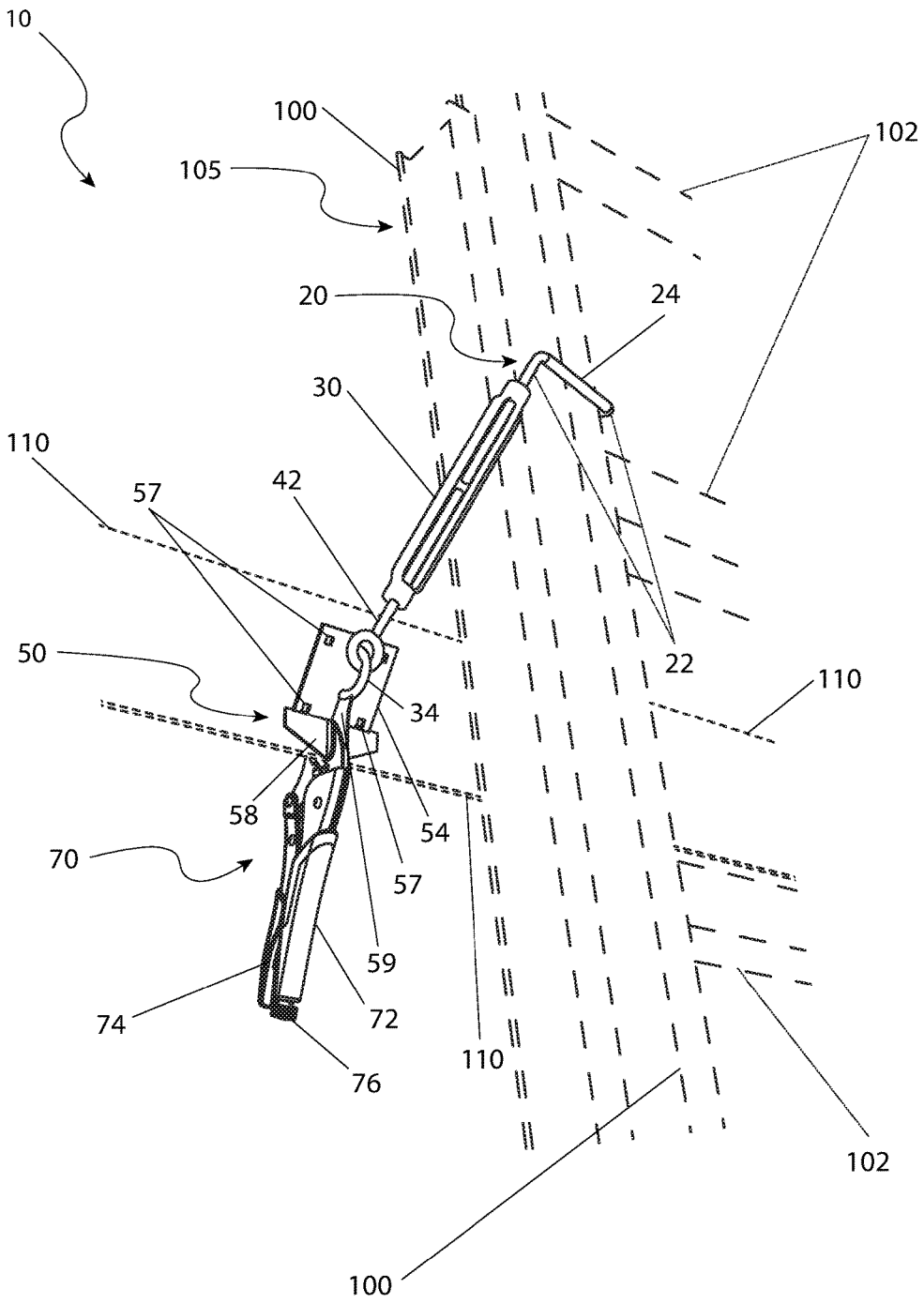
FIG. 1 is an environmental view of a ladder securing device 10 depicting an "in-use" state, according to an embodiment of the present invention.

10 ladder securing device
20 hook assembly
22 hook member
24 hook cover
30 turnbuckle body
34 first eyelet
40 clamp assembly
42 second eyelet
44 male threaded region
46 female threaded region
50 clamp assembly
52 upper jaw
54 upper plate
56 lower jaw
57 aperture
58 lower plate
59 gusset plate
70 clamp tool
72 stationary handle
74 clamping handle
76 adjusting knob
78 pivot pin
80 pivot member
100 side rail
102 rung
105 ladder
110 metal building edge

DETAILED DESCRIPTION OF THE PREFERRED EMBODIMENT

Figure 2:
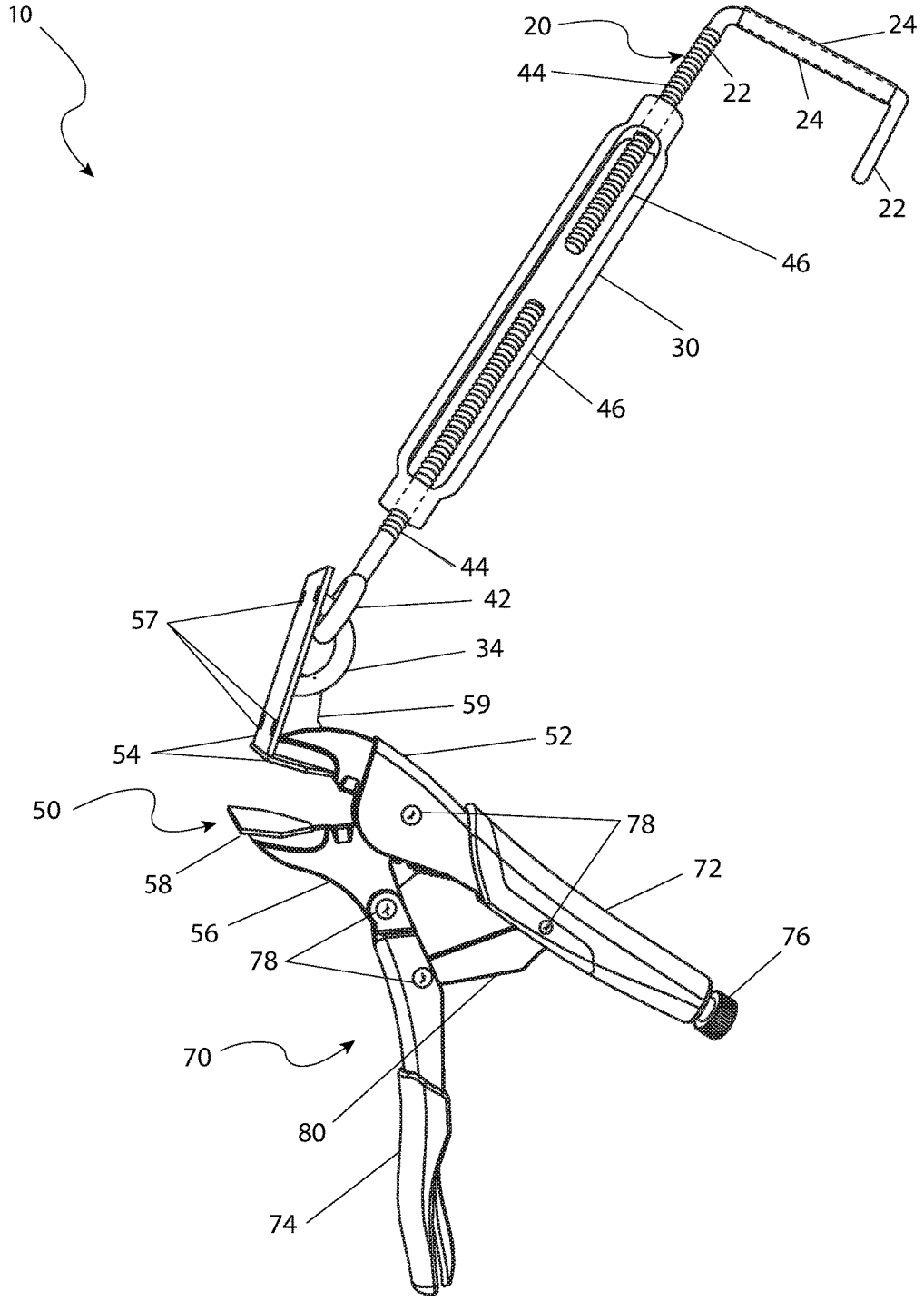
FIG. 2 is a side perspective view of the ladder securing device 10, according to an embodiment of the present invention; and, FIG. 3 is an exploded view depicting the portions of the ladder securing device 10, according to an embodiment of the present invention.
Figure 3:
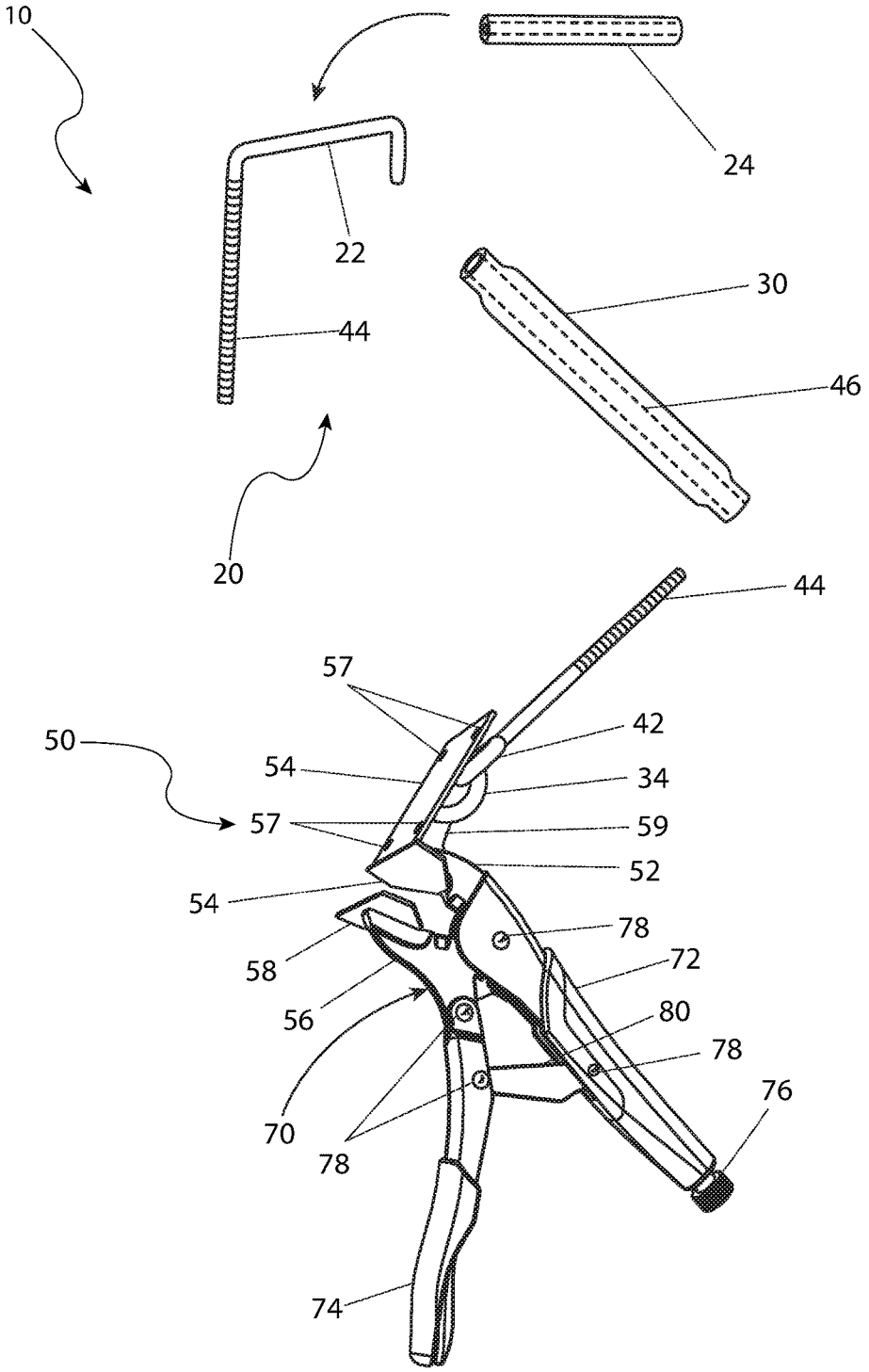

The best mode for carrying out the invention is presented in terms of its preferred embodiment, herein depicted within FIG. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a ladder securing device (herein described as the "device") 10, which provides a means to safely secure a ladder 105 to a metal edge portion 110 of an existing building structure during such activities as painting, construction, roofing projects, and the like. The device 10 includes a hook assembly 20, a turnbuckle body 30, and a clamp assembly 50. The portions of the device 10 are affixed to each other to form a length-adjustable linear assembly. It is envisioned that a pair of the devices 10 would typically be utilized upon an existing ladder 105 by engaging respective hook assemblies 20 along opposite side rail portions 100, between rung portions 102, to safely secure the ladder 105 to the existing metal building edge 110.

Referring now to FIG. 1, an environmental view of the device 10 depicting an "in-use" state, according to an embodiment of the present invention, is disclosed. A single unit of the device 10 is illustrated here with the hook assembly 20 securely engaged onto the side rail portion 100 of the ladder 105. The hook assembly 20 is threadingly engaged to a top portion of the turnbuckle body 30. In a similar manner, the bottom end of the turnbuckle body 30 is threadingly engaged in a pivoting manner with a second eyelet portion 42 of the clamp assembly 50 (see FIG. 2).

The clamp assembly 50 includes upper plate 54 and lower plate 58 portions which are motioned together via a clamp tool 70, to engage and clamp the device 10 to the metal building edge 110 (also see FIGS. 2 and 3). Once two (2) units of the device 10 are mounted upon each side rail 100 of the ladder 105 and to respective portions of the metal building edge portions 110 portions, a user may secure the devices 10 to the ladder 105 by applying a tension upon each device 10 by rotating respective turnbuckle body portions 30 to effect a reduction of an overall length of the devices 10.

The upper plate portion 54 of the clamp assembly 50 further includes a plurality of apertures 57 formed or machined through the upper plate 54. The apertures 57 are envisioned to be utilized to temporarily attach the device 10 to an existing wooden building structure using fasteners such as screws, lag bolts, or the like, thereby providing additional securement of the ladder 105 to a wooden building structure.

Referring now to FIGS. 2 and 3, side perspective and exploded views of the device 10, according to an embodiment of the present invention, are disclosed. The hook assembly 20 includes a strong metal hook member 22 having a protective cylindrical hook cover 24 upon an intermediate portion. The hook cover 24 is envisioned to be made using a rubber or a similar non-galling material, to provide protection to the ladder 105. An embodiment of the hook member 22 is shown here including three (3) linear portions formed at right angles to each other to form a three-sided structure intended to match and entrap a rectangular profile of an existing side rail portion 100 of the ladder 105 (see FIG. 1). The hook member 22 includes an integral male threaded region 44 along one (1) end portion which is in turn threadingly engaged into a female threaded region portion 46 of the turnbuckle body 31. In like manner, another female threaded region 46, located at an opposing end of the turnbuckle body 30, is threadingly attached to a corresponding male threaded region portion 44 of a second eyelet 42. It is envisioned that the threaded regions 44, 46 would utilize both left-hand and right-hand threads to provide a length-adjusting effect to the device 10 as the turnbuckle body 30 is rotated. The second eyelet portion 42 is in turn pivotingly engaged within a first eyelet portion 34 of the clamp assembly 50, thereby enabling a pivoting and variable angular relationship between the turnbuckle body 30 and the clamp assembly 50.

The clamp assembly 50 includes an upper jaw 52 which is welded to an upper plate 54 and a gusset plate 59, a lower jaw 56 which is welded to a lower plate 58, and a clamp tool 70. The clamp tool 70 provides a locking plier-type mechanism envisioned to provide similar construction and function as a VISE-GRIP® tool. The clamp tool 70 includes a stationary handle 72, a clamping handle 74, an adjusting knob 76, a plurality of pivot pins 78, and a pivot member 80.

The upper plate 54, lower plate 58, and gusset plate 59 are envisioned to be made of metallic flat stock. The gusset plate 59 is to be of a generally triangular shape and having the aforementioned first eyelet 34 welded to a hypotenuse edge portion. The remaining right-angle edges of the gusset plate 59 are welded to the upper jaw 52 and upper plate 54 portions. An embodiment of the upper plate portion 54 is shown here formed at a right angle having horizontal and vertical portions and generally "L"-shaped. An embodiment of the lower plate 58 is shown here forming a flat plate being positioned parallel to and subjacent to a bottom portion of the upper plate 54 and welded to the lower jaw portion 56 of the clamp tool 70. This enables the upper plate 54 and lower plate 58 to have parallel and aligning common facing surfaces. The embodiments of the upper plate 52 and lower plate 54 portions shown here, are envisioned to be designed and particularly shaped for use upon a metal building edge portion 110 of a particular profile. In use, the upper 52 and lower 54 plates are motioned toward each other via manual activation of the clamp tool 70 so as to clamp upon the existing metal building edge 110. It is envisioned that the upper 52 and lower 54 plates would be available for purchase having various shapes, so as to effectively clamp upon correspondingly shaped metal building edges 110 having various corresponding profiles, and as such should not be interpreted as a limiting factor of the device 10.

As a user motions the handle portions 72, 74 of the clamp tool 70 together, the upper 54 and lower 58 plates are motioned together to clamp upon the metal building edge 110. The clamp tool 70 is then temporarily locked in a closed position via the locking effect of the pivot pins 78 and pivot member 80 portions, in a similar manner as a VISE-GRIP® tool. Additionally, the adjusting knob 76 allows a user to adjust a clamping gap between the plates 54, 58 based upon a thickness of the metal building edges 110 (see FIG. 1).

It is envisioned that other styles and configurations of the present invention can be easily incorporated into the teachings of the present invention, and only one (1) particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: procure a model of the device 10 having clamping plate portions 54, 58 which match a profile of an intended metal building edge 110 to be clamped; setting up a ladder 105 at a proper angle and height along the metal building edge portion 110 of a building structure; climbing the ladder 105 while carrying a pair of the devices 10; installing one (1) of the devices 10 by positioning the clamp assembly 50 along the metal building edge 110; clamping the upper 54 and lower 58 plates of a device 10 together by collapsing the stationary 72 and clamping 74 handle portions of the clamp tool 70 together until they are locked in position; attaching the hook member 22 of the hook assembly 20 around one (1) side rail 100 of the ladder 105; attaching the other unit of the device 10 to the opposing metal building edge 110 and opposing side rail 100 as previously described; tightening both units of the device 10 upon the ladder 105 by rotating the turnbuckle bodies 30 until the corresponding hook members 22 are snug upon the respective side rails 100; performing such tasks as painting, general construction, roofing projects, and the like; and, benefiting from improved stability and safety while climbing or working upon a ladder 105, afforded a user of the present invention 10. Removal of the devices 10 from the ladder 105 may be achieved by performing the above steps in reverse order.

The aperture portions 57 of the upper plate 54 may be utilized to securely attach the device 10 temporarily to an existing wooden building structure, as needed. The device 10 may be attached to the existing wooden building by inserting and securing fasteners, such as screws of lag bolts through a plurality of the apertures 57 and into the wooden structure, thereby providing additional securement of the ladder 105.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A securing device, comprising:

a hook configured to engage a side rail portion of a ladder;

a turnbuckle having a first end adjustably attached to said hook; and, a clamp assembly adjustably and pivotally attached to a second end of said turnbuckle, capable of removable securement to a support structure, said clamp assembly further comprises an upper jaw with a generally L-shaped upper plate, a lower jaw with a lower plate and, a clamping tool for motioning said upper jaw and said lower jaw towards each other;

wherein said clamp assembly further comprises a gusset plate affixed between said upper plate and said upper jaw; and wherein said clamp assembly further comprises a turnbuckle eyelet having a first end removably attached to said turnbuckle second end and, a clamp eyelet located on a first side of said upper plate, capable of receiving a second end of said turnbuckle eyelet, wherein said gusset plate is affixed to said clamp eyelet.

2. The securing device of claim 1, wherein a hook assembly comprises:

a first hook portion having a first hook having a first end removably attached to said turnbuckle first end;

a second hook portion having a second hook having a first end perpendicularly extending away from said first hook having a second end; and, a third hook portion having a third hook having a first end perpendicularly extending away from a second hook having a second end, disposed parallel with said first hook portion.

3. The securing device of claim 1, wherein said upper plate and said lower plate have parallel and aligning facing surfaces.

4. The securing device of claim 1, wherein said upper plate and said lower plate have parallel and aligning facing surfaces.

5. A securing device, comprising:

a hook configured to engage a side rail portion of a ladder;

a hook cover for removable placement on a portion of said hook;

a turnbuckle having a first end adjustably attached to said hook; and, a clamp assembly adjustably and pivotally attached to a second end of said turnbuckle, capable of removable securement to a support structure, said clamp assembly further comprises an upper jaw with a generally L-shaped upper plate, a lower jaw with a lower plate, and, a clamping tool for motioning said upper jaw and said lower jaw towards each other;

wherein said clamp assembly further comprises a gusset plate affixed between said upper plate and said upper jaw; and wherein said clamp assembly further comprises a turnbuckle eyelet having a first end removably attached to said turnbuckle second end, and, a clamp eyelet located on a first side of said upper plate, capable of receiving a second end of said turnbuckle eyelet, wherein said gusset plate is affixed to said clamp eyelet.

6. The securing device of claim 5, wherein a hook assembly comprises:

a first hook portion having a first hook having a first end removably attached to said turnbuckle first end;

a second hook portion having a second hook having a first end perpendicularly extending away from a first hook second end; and, a third hook portion having a third hook having a first end perpendicularly extending away from said second hook having a second end, disposed parallel with said first hook portion.

7. The securing device of claim 5, wherein said upper plate and said lower plate have parallel and aligning facing surfaces.

8. The securing device of claim 7, wherein said upper plate and said lower plate have parallel and aligning facing surfaces.

* * * * *